United States Patent [19]

Scroggins, Sr.

[11] Patent Number: 4,771,988

[45] Date of Patent: Sep. 20, 1988

[54] LIFTING APPARATUS FOR HEAVY FOLDING DOORS

[76] Inventor: Philip E. Scroggins, Sr., P.O. Box 1642, Smyrna, Ga. 30081

[21] Appl. No.: 542,064

[22] Filed: Oct. 14, 1983

[51] Int. Cl.[4] ..... B66D 1/14; B66D 1/36

[52] U.S. Cl. ..... 254/336; 254/47; 254/357

[58] Field of Search ..... 254/334, 335, 336, 338, 254/227, 285, 324, 325, 326, 327, 47, 357; 248/354 P; 182/39

[56] References Cited

U.S. PATENT DOCUMENTS

| | | | |
|---|---|---|---|
| 301,381 | 7/1884 | McCreery | 254/338 |
| 715,747 | 12/1902 | Bock | 254/338 X |
| 783,672 | 2/1905 | Bock | 254/338 X |
| 1,148,382 | 7/1915 | Hawkins | 254/334 |
| 2,364,547 | 12/1944 | Olsen | 182/39 X |
| 2,604,303 | 7/1952 | Grady | 254/326 |
| 2,859,881 | 11/1958 | Coryell | 254/336 X |
| 2,985,430 | 5/1961 | Greenwood | 254/338 |
| 3,340,960 | 9/1967 | Wilson | 182/39 |

FOREIGN PATENT DOCUMENTS

| | | | |
|---|---|---|---|
| 208058 | 8/1959 | Austria | 254/338 |
| 466688 | 5/1914 | France | 254/334 |

*Primary Examiner*—Stuart S. Levy
*Assistant Examiner*—Joseph J. Hail, III
*Attorney, Agent, or Firm*—Patrick F. Henry, Sr.

[57] ABSTRACT

A single, telescopic tubular steel pole is supported by an elongated steel channel base having rubber wheels on each end. The pole is leaned and supported against the top of a door opening in a building by means of a removable top frame having a longitudinal angle steel member reinforced by diagonal struts on other angle iron members which form a longitudinal channel welded to the top of the pole. A winch system employs a cable which passes around two pulleys on the top member to support a heavy steel, folding door.

11 Claims, 1 Drawing Sheet

LIFTING APPARATUS FOR HEAVY FOLDING DOORS

BACKGROUND OF THE INVENTION

1. Field of the Invention

Lifting and support devices employing a vertically oriented pole with a winch and cable system for lifting a heavy steel door into an opening for installation.

2. Discussion of Prior Procedures

There are various types of lifting devices employing frames and supports which are installed from the ceiling to the floor, such as in U.S. Pat. No. 2,985,430, or from the floor to the ceiling with attachment to a wall structure such as shown in U.S. Pat. No. 715,747. There are also ladder-type hoisting devices such as shown in U.S. Pat. No. 1,148,382 which require substantial frame structure including a special base which must be properly supported. The present device is a simpler structure than those presented in the above-noted patent as well as other prior procedures and employs an elongated support which may be leaned without attachment to any building structure so as to lift and support an object such as a heavy folding steel door during installation and adjustment.

SUMMARY OF THE INVENTION

An elongated support constructed from steel or other structurally strong material is supported on a transverse base which may have end wheels mounted thereon. The base may include diagonal strut members. The top of the support is leaned against a structure such as the wall of a building and has a projecting pulley frame thereon comprising a transverse frame for engagement with the wall of the building above the door opening.

An object of this invention is to provide an elongated lifting device which may be leaned against a wall at an angle to facilitate the installation of a heavy door in a wall opening.

Another object of this invention is to provide a single pole device which may be leaned against a wall without any attachments to the building structure.

Still another object of this invention is to provide a single pole erection device which is adjustable in length and may be easily constructed in different sizes.

A primary object of the present invention resides in the simplicity of construction whereby a typical lightweight version of the device would be approximately 160 lbs. arranged so that the device can be disassembled into a number of separate component parts for shipment or storage.

A further object is found in the arrangement whereby a larger and stronger similar version of the erection device would weigh approximately 285 lbs. and be capable of lifting a load capacity of 2,200 lbs., such as a steel garage door which is 24 ft. wide and up to 22 ft. high within four inches of the ceiling of a building. Therefore no headroom is required for the use of the present device.

Other and further objects and advantages of the present invention will be apparent upon reading the description of the preferred embodiment taken in conjunction with the accompanying drawings.

DESCRIPTION OF A PREFERRED EMBODIMENT

Figure 2:
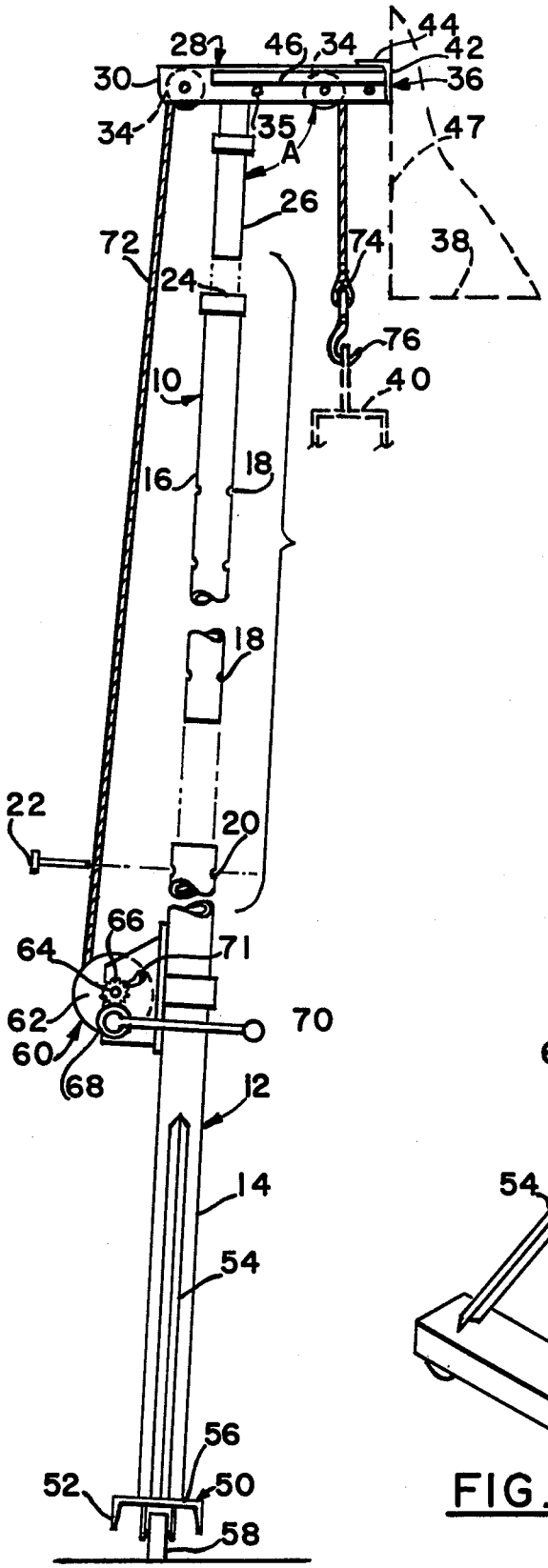
FIG. 2 is a side elevation view of the device shown in FIG. 1 partially disassembled to illustrate the separation of the component parts.
Figure 1:
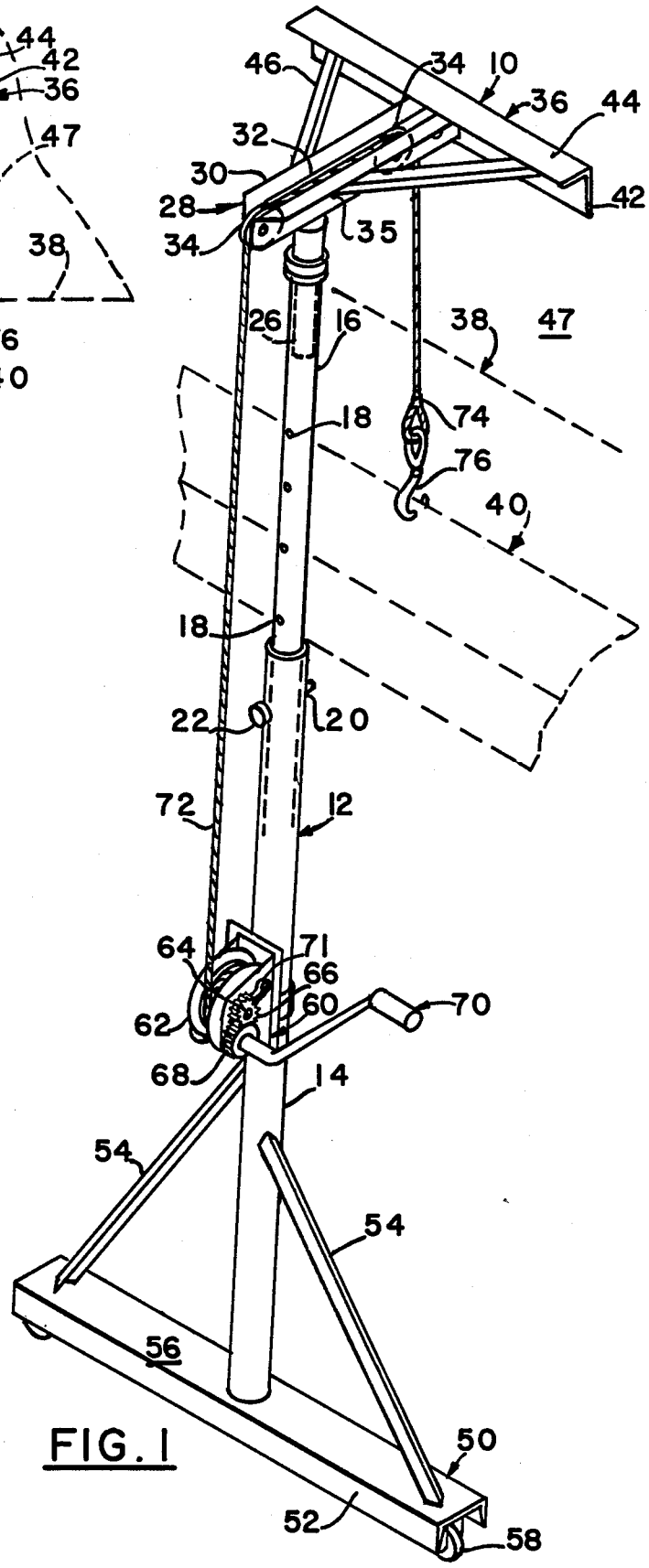
FIG. 1 is a perspective view of the present device assembled and tilted into position to lean against the wall into which is being raised a heavy garage door.

The lifting device 10 comprises a tubular steel pole member 12 having a bottom pole section 14 and a top pole section 16 which is slidably and telescopically mounted inside the tubular bottom 14 for adjustment therein. Top section 16 is tubular and has a plurality of aligned holes 18 therein which are capable of being matched selectively with a pair of aligned holes 20 in bottom 14 to receive a securing pin 22 therein for the purpose of adjusting top member 16 inside bottom member 14 and securing same at the desired length. The upper end of top section 16 is a socket 24 which removably receives therein a tubular top frame member 26 which is fixed to the top frame 28 whereby the top frame 28 may be removed and replaced easily.

Top frame 28 comprises a pair of spaced, opposed, longitudinal angle iron members 30 welded to the top of top frame member 26 with a longitudinal space 32 therein in which is mounted a pair of spaced idler transfer sheaves or pulleys 34 selectively in one of several holes 35. A transverse engaging member 36 is welded to the end of the members 30 for engagement against the side of a building structure above an opening 38 in which is being erected a heavy roll-up or folding steel garage door 40. The engaging member 36 is an angle iron member with a face 42 and a top 44 braced by diagonal strut members 46 which are welded in place on the angle iron members 30 and the back of the face member ber 42 of 36. The angle iron members and therefore the entire top frame member 28 are not perpendicular to the centerline of the top frame member 26 or the pole 12 but rather as seen in FIG. 2 the angle A is slightly more than 90° so that the centerline of the top frame 28 between the two pulleys 34 and measured along the angle iron members 30 is substantially horizontal as seen in FIG. 2 when the pole 12 is leaned at an angle against the wall 47 of the building structure.

A base 50 comprises an open steel channel member 52 which is welded to the bottom end of pole 12 substantially in the center of channel 52 and the pole 12 is braced by means of diagonal struts or brace members 54 welded at respective ends on the top 56 of channel 52 and to the surface of the pole 12 on the bottom section 14. The opposite ends of channel 52 each is provided with a wheel 58 which has the wheel axis mounted transversely across the channel 52 whereby the assembled device 10 can be rolled in a direction along the longitudinal centerline of channel 52 but once in place leaning against the building structure 47 will not displace outwardly at the bottom. Therefore, the device can be easily rolled from one position to another along the top of the opening 38 and the building wall 47.

The system for raising and lowering the door 40 on the device 10 comprises a winch arrangement 60 having a reel 62 thereon which rotates on a shaft 64 having a gear 66 thereon driven by a drive gear 68 which is turned by a crank 70, all conventional winch structure.

The gears and drum 62 may be provided with any well known safety device such as a pawl 71 which selectively engages gear 66 or if preferred a pin system (not shown) which employs a removable pin insertable through the reel 62 to prevent accidental dislodgement. A cable 72, wound on drum 62, passes across the respective spaced sheaves or pulleys 34 and has the end 74 thereof provided with a suitable fastening device, such as a hook 76, or a U-bolt shackle (not shown) or any other well known suitable fastening device to attach the cable 72 to the door 40. The front sheaves 34 may be selectively moved to one of the holes 35 as desired for a particular job situation. Accordingly, a first hole 35 would be 2½ inches from the front of the rear sheave 34 and the second hole 35 is 3½ inches from the first hole 35 and the third hole 35 is 3½ inches from the second hole 35. Pole 12 has four adjustment holes which may be spaced as holes 35.

As previously stated, it is believed that two versions of the same device 10 would be sufficient for most uses and by way of example the total weight of the larger version would be about 285 lbs. whereas the smaller version would be about 160 lbs. Both versions could be disassembled into three components-the bottom 14 with the base 50, the top 16 and the top frame 28. The lifting capacity of the larger version would be about 2,200 lbs. and it could lift a load approximately 24 ft. wide and up to 22 ft. high whereas the lifting capacity of the smaller device would be something in the order of 1,400 lbs. to lift a load approximately 16 ft. wide and up to 14 ft. high. It is emphasized that no head room is required for the top of the pole to operate and it can lift a load such as the garage door 40 to within 4 inches of the ceiling, unlike some prior lifting devices. Two persons could move the larger version anywhere with ease and at times one man can move the pole 12. Pole 12 is made at such a pitch or angle as to actually set back against itself so that there is no danger of slipping, buckling or tilting backwards. Also, the adjustment is such that the bottom 14 and top 16 can be adjusted in 6-inch increments. The device 10 does not require any guidelines or stabilizer lines for stabilization while lifting a heavy load.

While I have shown and described a particular embodiment of my invention together with a suggested mode of operation this is by way of illustration only of a preferred embodiment because there are various alterations, changes, deviations, revisions and departures which may be made in the preferred embodiment without avoiding the scope of my invention as defined only by a proper interpretation of the appended claims.

What is claimed:

1. In a device for lifting a large, long and wide object, such as a folding steel garage door, into position in an opening in a building wall wherein there may be limited headspace above said opening:

a transverse base having opposite ends, a longitudinal member mounted on said base for tilting to lean the top thereof against a support such as the wall of a building structure, said longitudinal member being longitudinally adjustable, a top frame on said longitudinal member comprising a support means projecting outwardly from the top of the longitudinal member for installation where there is low head room of only a few inches and a transverse engaging member mounted transversely across said support means having spaced locations contacting but not attached to the wall of the building above a particular location such as the top of a door opening for movement and relocation thereon, cable means on said longitudinal member and one end of the cable being suspended from said top frame, means for winding and unwinding said cable on said longitudinal member, said top frame having first and second sheaves mounted in spaced relation thereon, said cable passing around said sheaves, said support means projecting outwardly from the top of the longitudinal member being mounted at an angle of more than 90° to the longitudinal centerline of said longitudinal member whereby, when said longitudinal member is leaned to place said transverse engaging member against a support, said projecting support means is substantially horizontal thereby placing said cable between said sheaves in approximate horizontal position, ground support base moving means adjacent each opposite respective end of said base for supporting and moving said longitudinal member relative to the wall in a transverse direction while said top frame is adjacent or against said wall and said longitudinal member is elevated with said object hanging in place on said cable whereby said entire device may be relocated in selected increments along said wall so as to reposition said hanging object without returning same to the ground.

2. The device claimed in claim 1 wherein said base comprises reinforcing strut members attached between said base and said longitudinal member.

3. The device claimed in claim 2 wherein said top frame comprises reinforcing, diagonal strut members attached between said projecting support means and said transverse member.

4. The device in claim 1 wherein said top frame comprises a longitudinal slot therein and said first and second sheaves being mounted in spaced relation in said slot and having said cable passing therearound.

5. The device in claim 4: said base comprising reinforcing strut members attached between said base and said longitudinal member, said top frame comprising reinforcing, diagonal strut members attached between said projecting support means and said transverse member.

6. The device in claim 4 wherein said longitudinal member is a single pole having sections adjustable in length.

7. The device in claim 6 wherein said pole is telescopically adjustable.

8. The device in claim 6 wherein there is a top end on said single pole which comprises a socket; and said top frame comprises a socket member insertable into the socket.

9. The device claimed in claim 4 wherein said top frame is constructed from a pair of opposed, spaced angle members having said sheaves confined therebetween for operation therein.

10. The device in claim 9 wherein said transverse engaging member is an angle member attached to the end of said projecting support means.

11. The device in claim 4 wherein at least one of said sheaves is adjustable on said top frame and with respect to the other sheave to change the distance therebetween.

* * * * *